US009744767B2

(12) United States Patent
Nojo et al.

(10) Patent No.: US 9,744,767 B2
(45) Date of Patent: Aug. 29, 2017

(54) LIQUID DISCHARGE HEAD AND METHOD OF MANUFACTURING THE SAME

(71) Applicant: CANON KABUSHIKI KAISHA, Tokyo (JP)

(72) Inventors: Naruyuki Nojo, Yokohama (JP); Hiromasa Amma, Kawasaki (JP); Takuya Iwano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/051,525

(22) Filed: Feb. 23, 2016

(65) Prior Publication Data

US 2016/0250854 A1 Sep. 1, 2016

(30) Foreign Application Priority Data

Feb. 26, 2015 (JP) ..... 2015-036827

(51) Int. Cl.
*B41J 2/25* (2006.01)
*B41J 2/16* (2006.01)
*B41J 2/14* (2006.01)

(52) U.S. Cl.
CPC . *B41J 2/16* (2013.01); *B41J 2/14* (2013.01); *B41J 2002/14491* (2013.01); *B41J 2202/08* (2013.01); *B41J 2202/21* (2013.01)

(58) Field of Classification Search
CPC ..... B41J 2/14; B41J 2/14072; B41J 2/14201; B41J 2/235; B41J 2/25; B41J 2/26; B41J 2/255; B41J 2002/14491; B41J 2202/08; B41J 2202/18; B41J 2202/19
See application file for complete search history.

(56) References Cited

U.S. PATENT DOCUMENTS 5,652,608 A * 7/1997 Watanabe ..... B41J 2/14024 347/50
5,734,394 A * 3/1998 Hackleman ..... B41J 2/155 347/42
2006/0071971 A1* 4/2006 Mori ..... B41J 2/14072 347/44
2008/0303864 A1* 12/2008 Silverbrook ..... B41J 2/04518 347/42
2010/0309258 A1* 12/2010 Miyazaki ..... B41J 2/14072 347/50
2011/0228000 A1* 9/2011 Silverbrook ..... B41J 2/1412 347/40
2013/0135394 A1* 5/2013 Saikawa ..... B41J 2/14072 347/50

FOREIGN PATENT DOCUMENTS

JP H10230602 A 9/1998

* cited by examiner

*Primary Examiner* — Geoffrey Mruk
*Assistant Examiner* — Scott A Richmond
(74) *Attorney, Agent, or Firm* — Canon U.S.A. Inc., IP Division

(57) ABSTRACT

A liquid discharge head includes a wiring portion; a print element board including an element for applying discharge energy to liquid; and an electric wiring board including a connecting portion connected to the wiring portion and electrically connecting the wiring portion and the print element board. The connecting portion is provided with a cut portion at a position between both end portions in a width direction of the connecting portion, and a length of the cut portion in the width direction is shorter than a length of the cut portion in a direction orthogonal to the width direction.

12 Claims, 7 Drawing Sheets

LIQUID DISCHARGE HEAD AND METHOD OF MANUFACTURING THE SAME

BACKGROUND OF THE INVENTION

Field of the Invention

This disclosure relates to a liquid discharge head and a method of manufacturing the same.

Description of the Related Art

Examples of a liquid discharge head to be used in a liquid discharge apparatus such as an inkjet printer include a configuration including a print element board, a supporting member configured to support the print element board, an electric wiring board, and a wiring portion. The print element board includes discharge ports configured to discharge liquid, and an energy generating element configured to generate discharge energy for discharging the liquid. The electric wiring board is interposed between the print element board and the wiring portion, and configured to transmit an electric signal supplied to the wiring portion to the print element board.

A liquid discharge head disclosed in Japanese Patent Laid-Open No. 10-230602 is provided with connecting terminals (connecting pads) and positioning terminals respectively on the wiring portion and the electric wiring board. The wiring portion and the electric wiring board are arranged at positions where the connecting terminals overlap each other and are connected to each other by aligning positioning terminals on both of the boards respectively. Accordingly, the connecting terminals are electrically connected to each other and are mechanically fixed.

In liquid discharge heads of recent years, the number of energy generating elements mounted on the print element board is increased in order to improve a recording speed. In keeping with this trend, the number of wires for transmitting and receiving an electric signal to be supplied to the energy generating element and the number of connecting terminals also increase. Consequently, an increase in size of the electric wiring board, more specifically, an increase in width is required.

The electric wiring board and the wiring portion are often connected by thermocompression bonding. Normally, a base material of the electric wiring board and a base material of the wiring portion are different, and a magnitude of thermal expansion is different between the electric wiring board and the wiring portion at the time of connection (at the time of thermocompression bonding) depending on the difference coefficient of linear expansion between these base materials. In other words, since an amount of expansion (an amount of elongation) of the electric wiring board and an amount of expansion (amount of elongation) of the wiring portion are different at the time of connection, the relative position therebetween is misaligned. Since the size of the member is proportional to an amount of elongation, the wider the width of the connecting portion, the larger the elongation in a width direction it has, and a significant misalignment of the relative position may result. Consequently, connection failure due to insufficient contact between the connecting terminals and short circuit due to accidental connection between the connecting terminals which should not contact with each other may occur.

SUMMARY OF THE INVENTION

It is an object of the invention to provide a liquid discharge head which can restrict misalignment of relative position even though a width of a connecting portion is wide with respect to a wiring portion of an electric wiring board, and can reduce the probability of an occurrence of connection failure or short circuit, and a method of manufacturing the liquid discharge head.

This disclosure provides a liquid discharge head of this disclosure including: a wiring portion; a print element board including an element for applying discharge energy to liquid; an electric wiring board including a connecting portion connected to the wiring portion and electrically connecting the wiring portion and the print element board, and the connecting portion is provided with a cut portion at a position between both end portions in a width direction of the connecting portion, in which a length of the cut portion in the width direction is shorter than a length of the cut portion in a direction orthogonal to the width direction.

In this configuration, the connecting portion of the electric wiring board with respect to the wiring portion is divided into a plurality of strips by a cut portion and the amount of elongation in the width direction due to the thermal expansion is restricted because the width of each of the divided strips is small.

According to the invention, since the amount of elongation of the connecting portion of the electric wiring board with respect to the wiring portion in the width direction due to thermal expansion can be reduced, and thus misalignment of relative position between the electric wiring board and the wiring portion can be reduced. Accordingly, connection failure and occurrence of short circuit can be reduced. Since the length of the cut portion in the width direction is shorter than the length in a direction orthogonal to the width direction, the amount of elongation of the electric wiring board in the width direction due to thermal expansion may be reduced while restricting an increase in size of the electric wiring board in the width direction.

Further features of the present invention will become apparent from the following description of exemplary embodiments with reference to the attached drawings.

DESCRIPTION OF THE EMBODIMENTS

Hereinafter, embodiments of the present invention will be described with reference to drawings.

Figure 1:
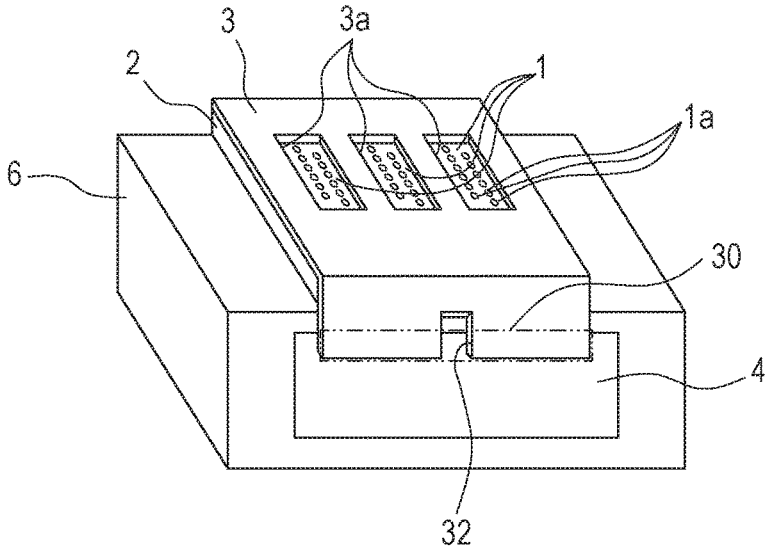
FIG. 1 is a perspective view illustrating a liquid discharge head of the invention.

FIG. 1 illustrates a liquid discharge head of the invention. The liquid discharge head includes print element boards 1, a supporting member 2, an electric wiring board 3, a wiring portion 4, and a housing 6. Specifically, the supporting member 2 is mounted on an upper surface of the parallelepiped housing 6 and a print element boards 1 are stacked on an upper surface of the supporting member 2. The wiring portion 4 is arranged on one side surface of the housing 6 adjacent to the upper surface thereof. The electric wiring board 3, which is a flexible wiring board, is arranged so as to extend over the print element boards 1 on the supporting member 2 and the wiring portion 4. A portion overlapping with the wiring portion 4 of the electric wiring board 3 is referred to as a connecting portion (outer lead portion) 30. In an example illustrated in FIG. 1, the wiring portion 4 and the housing 6 are wiring boards separate from each other, and are adhered to the one side surface of the housing 6. However, the wiring portion 4 may be part of the housing 6.

The print element boards 1 include a plurality of discharge ports 1*a* for discharging liquid droplets, liquid chambers corresponding to the discharge ports 1*a*, although not illustrated, and energy generating elements arranged in the liquid chambers respectively. The discharge ports 1*a* are exposed through openings 3*a* of the electric wiring board 3.

Figure 2A:
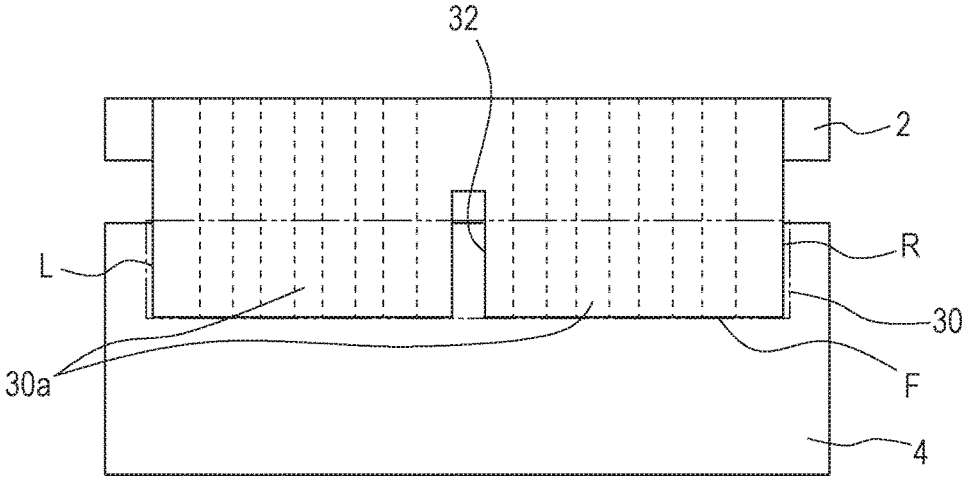
FIG. 2A is a development view illustrating a connecting portion between an electric wiring board of the liquid discharge head and the wiring portion in FIG. 1.
Figure 2B:
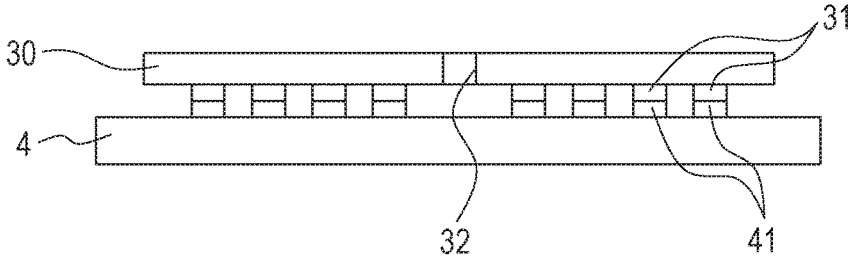
FIG. 2B is a front view illustrating the connecting portion between the electric wiring board of the liquid discharge head and the wiring portion in FIG. 1.

An development view of a connecting portion of the electric wiring board 3, the wiring portion 4, and the supporting member 2 is illustrated in FIG. 2A, and a front view of the connecting portion is illustrated in front view of FIG. 2B. As illustrated in FIG. 2B, a plurality of connecting terminals 41 on a wiring portion side are arranged on an outer surface of the wiring portion 4 in a row extending along a width direction. A plurality of connecting terminals 31 on an electric wiring board side are arranged on the connecting portion 30 of the electric wiring board 3 in a row extending along the width direction so as to oppose the row of the plurality of connecting terminals 41 on the wiring portion side. Electric wires connected to the connecting terminals 31 on the electric wiring board side are illustrated by broken lines in FIG. 2A. When the connecting portion 30 of the electric wiring board 3 is connected to the wiring portion 4, the connecting terminals 31 on the electric wiring board side are connected in contact with the connecting terminals 41 on the wiring portion side, respectively. The connection portion 30 of electric wiring board 3 is provided with a cut portion 32 at a position in the middle of both end portions R and L in the width direction. The cut portion 32 is formed from a position of an end edge F extending in the width direction of the connecting portion 30 and extends in a direction intersecting (which can be orthogonal to) the width direction of the connecting portion 30. The cut portion 32 is provided between the connecting terminals on the electric wiring board side so as to split the rows of the connecting terminals 31 on the electric wiring board side, and extends beyond the connecting portion 30.

The connecting portion 30 of the electric wiring board 3 is connected to the wiring portion 4 mainly by thermocompression bonding between the connecting terminals 31 on the electric wiring board side and the connecting terminals 41 on the wiring portion side. The electric wiring board 3 and the wiring portion 4 expand respectively by heat received at the time of thermocompression bonding, and an amount of expansion (amount of elongation) is different in accordance with a difference in coefficient of linear expansion. However, the connecting portion 30 of the electric wiring board 3 is provided with the cut portion 32, and the connecting portion 30 are divided into a plurality of (two in the illustrated example) divided strips 30*a*, and the width of each of the divided strips 30*a* is small. Since a width of a substance and the amount of thermal expansion in the width direction are substantially proportional, the amount of expansion of each of the divided strips 30*a* in the width direction having a small width is suppressed to a small extent. When the thermally expanded portions of each of the divided strips 30*a* are accommodated within the cut portion 32, no impact is exerted on the other divided strip 30*a*. In this manner in this embodiment, the difference in amount of thermal expansion (amount of elongation) in the width direction between the divided strips 30*a* and the wiring portion 4 is reduced with the provision of the cut portion 32 on the connecting portion 30, misalignment of relative position between the connecting terminals 31 on the electric wiring board side and connecting terminals 41 on the wiring portion side in the width direction is suppressed. Consequently, connection failure and short circuit are suppressed.

In this configuration, when an electric signal is supplied from a main body of a liquid discharge apparatus, which is not illustrated, to the wiring portion 4, the electric signal is transmitted to the electric wiring board 3 by electric connections of the connecting terminals 41 and 31. The electric signal is transmitted from the electric wiring board 3 to the print element boards 1, and is supplied to the energy generating element, which is not illustrated. The energy generating element to which the electric signal is supplied applies discharge energy (heat or pressure) to liquid in the liquid chamber, and the liquid applied with the discharge energy is discharged outward from the discharge ports 1*a*.

Figure 3C:
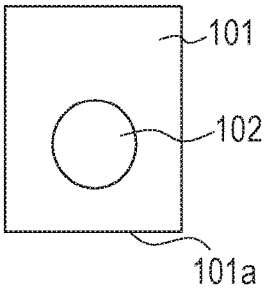
FIG. 3C is a side view of a thermocompression bonding member in Example 1 of the invention.
Figure 3A:
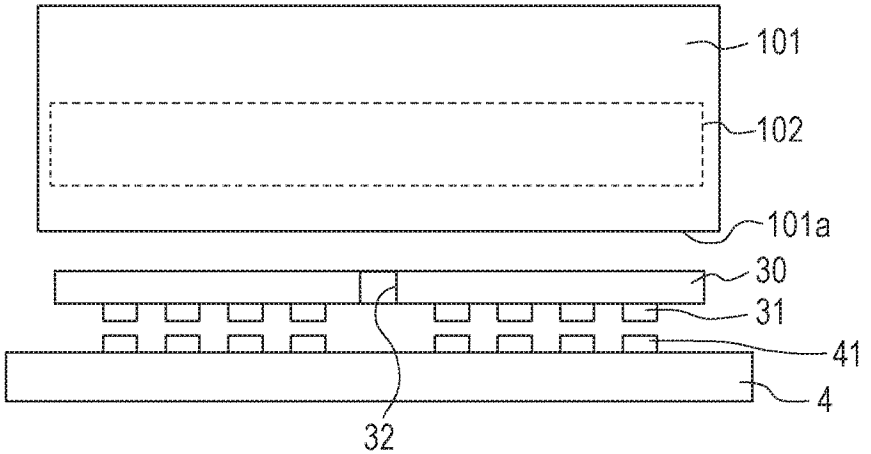
FIG. 3A is a front view illustrating a process of connection of the electric wiring board to the wiring portion in Example 1 of the invention.
Figure 3B:
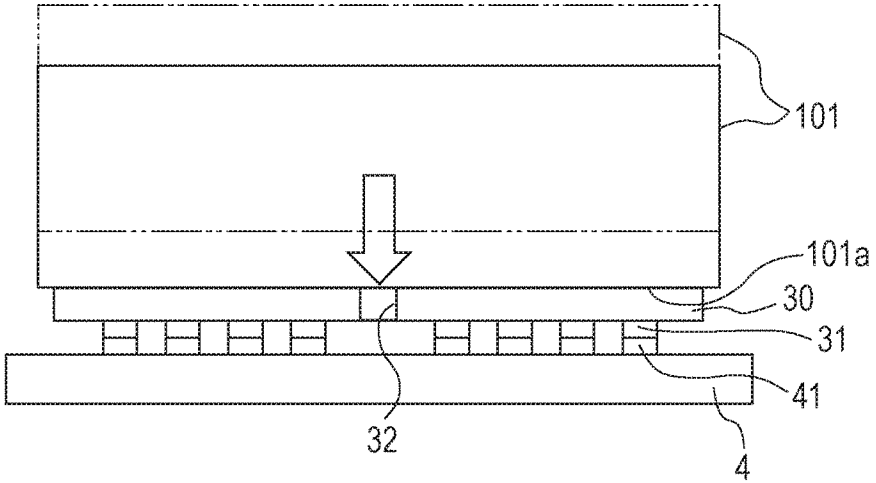
FIG. 3B is front view illustrating a process of connection of the electric wiring board to the wiring portion in Example 1 of the invention.

A method of manufacturing the liquid discharge head will be described. As described above, the supporting member 2 is stacked on the upper surface of the housing 6, and the wiring substrate, which corresponds to the wiring portion 4, is mounted on one side surface. Subsequently, the print element boards 1 are stacked on the supporting member 2. Then, the electric wiring board 3 is arranged so as to extend over the print element boards 1 and part of the wiring portion 4. At this time, the electric wiring board 3 is arranged so that the plurality of connecting terminals 31 provided on the connecting portion 30 are connected to the connecting terminals 41 of the wiring portion 4, respectively. Then the connecting portion 30 is connected to the wiring portion 4. Specifically, the connecting portion 30 is pressed against the wiring portion 4 as illustrated in FIG. 3B by a thermocompression bonding member 101 provided with a heater 102 integrated therein and includes a flat surface 101*a* as illustrated in FIGS. 3A and 3C. At this time, the connecting portion 30 and the wiring portion 4 are heated by the heater 102 of the thermocompression bonding member 101 and at the same time a pressure is applied thereto, whereby the connecting terminals 31 and 41 are respectively thermocompression bonded and fixed with each other.

The electric wiring board 3 and the wiring portion 4 are thermally expanded by heat applied by the heater 102 at the time of thermocompression bonding. The thermal expansion will be described. An absolute value of the amount of elongation by the thermal expansion is determined by the following elements.

(1) In the case where the base materials of the electric wiring board 3 and the wiring portion 4 are different from each other, coefficients of linear expansion of these materials are also different. For example, the base material of the electric wiring board 3 is TAB tape formed of coefficient of polyimide having a linear expansion of approximately 12 ppm, and the base material of the wiring portion 4 is glass epoxy resin having a coefficient of linear expansion of approximately 21 ppm. When considering only these base materials, the glass epoxy resin has a larger coefficient of linear expansion than the TAB tape.

(2) However, when the thermocompression bonding member 101 presses the TAB tape (electric wiring board 3) toward the glass epoxy resin (wiring portion 4), heat from the heater 102 transfers faster through the TAP tape than through the glass epoxy resin.

(3) In order to produce the liquid discharge heads efficiently in a short time, the thermcompression bonding process is desired to be performed in a short time. Therefore, the connecting portion 30 is heated to a desired temperature in a short time. However, at this time, the electric wiring board 3 and the wiring portion 4 cannot be heated entire to the desired temperature, and partial heat distribution is caused.

(4) Heat transferred through the wiring portion 4 in a thickness direction is higher on a side closer to the connecting portion 30 of the electric wiring board 3, and lower on a side farther from the connecting portion 30, so that the heat distribution is caused.

The amount of elongation of the electric wiring board 3 and the wiring portion 4 are not determined only by the coefficient of linear expansion of the base material, and the above-described elements (1) to (4) may impact thereon (for example, an impact of the heat distribution). The thickness of the base material (TAB tape) of the general electric wiring board 3 is approximately 0.1 mm, and the thickness of the base material (glass epoxy resin) of the wiring portion 4 is approximately 0.5 mm. In this manner when the wiring portion 4 is thick, the amount of elongation of the wiring portion 4 is small due to an impact of the heat distribution in accordance with the thickness of the base material.

Figure 4:
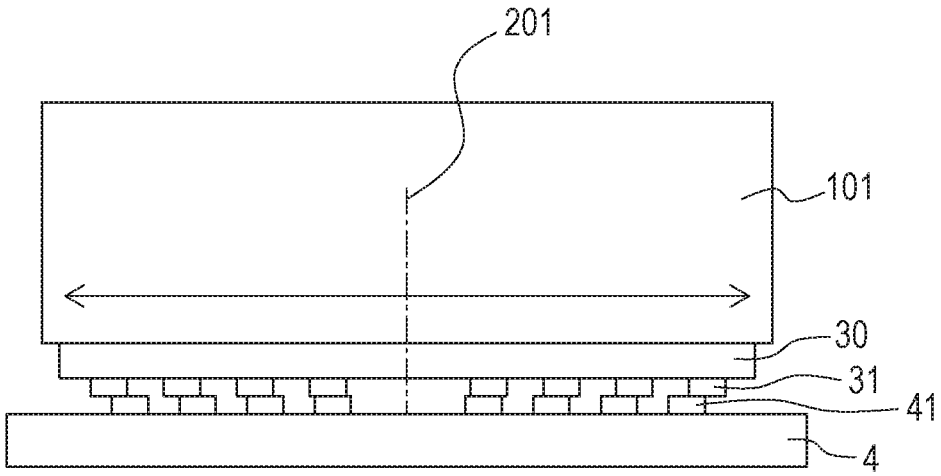
FIG. 4 is a front view illustrating a process of connection of the electric wiring board, which is not provided with a cut portion, to the wiring portion.

If the connecting portion 30 of the electric wiring board 3 is not provided with the cut portion 32, the actual amount of elongation of the connecting portion 30 (TAB tape) becomes larger than that of the wiring portion 4 (glass epoxy resin) from the elements (1) to (4) and the like described above. As illustrated in FIG. 4, the elongation in the width direction occurs from a center 201 of a heated portion toward both sides as indicated by an arrow. The wide connecting portion 30 of the electric wiring board 3 have a significant elongation of several micrometer to several tens of micrometer in the width direction although it depends on production conditions and the like. By the impact of the elongation, a significant relative positional misalignment may occur between the connecting terminals 31 and 41 located on an outer peripheral side of the connecting portion 30, and although it depends on the conditions such as a heating temperature of a pressurizing force, and the like, a significant misalignment of relative position on the order of several micrometer to several tens of micrometer in the width direction, for example, may occur. Accordingly, when an electrical connection failure may occur.

Therefore, in this embodiment, the connecting portion 30 of the electric wiring board 3 is provided with the cut portion 32 as illustrated in FIGS. 2A and 2B, and FIGS. 3A and 3B. The cut portion 32 of this embodiment is provided at substantially the center of the connecting portion 30 in the width direction so as to divide the connecting portion 30 into substantially two halves, and extends substantially perpendicular to the width direction inward of the electric wiring board 3 beyond the connecting portion 30. However, as illustrated in FIG. 2A, the length of the cut portion 32 does not reach a portion where the electric wiring board 3 contacts the supporting member 2. The width of the cut portion 32 can be larger than the amount of expansion (amount of elongation) of each of the divided strips 30*a* in the width direction by heat at the time of thermocompression bonding. Accordingly, mutual interference between the divided strips 30*a* of the expanded electric wiring board after the thermocompression bonding is further suppressed. Although the cut portion 32 needs only be provided between both end portions of the connecting portion 30 in the width direction, the cut portion 32 can be provided near the center when considering suppression of positional alignment. By the term "near the center" is meant a position at a length of 4 to 6 from one end letting the length between both end portions be 10. By the term "position of the cut portion" is meant the position of the center of the cut portion.

EXAMPLES

Further specific examples of the invention will be described below.

Example 1

Figure 5A:
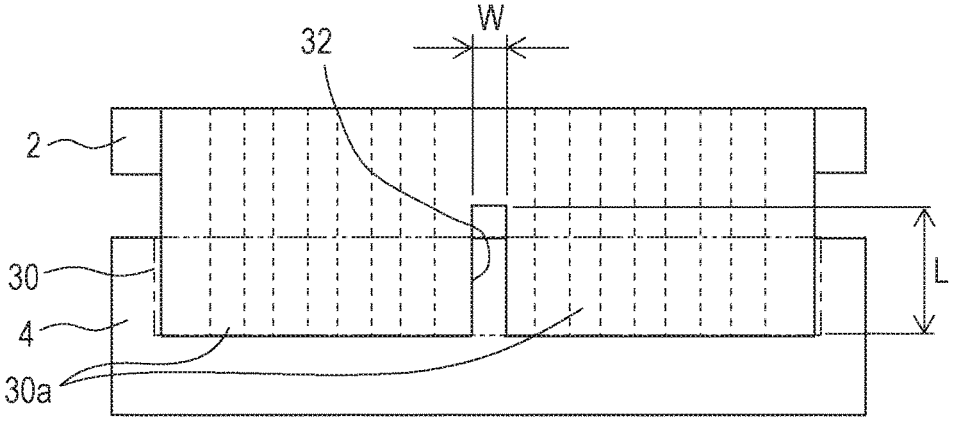
FIGS. 5A and 5B are a development view and a front view illustrating the connecting portion between the electric wiring board and the wiring portion in Example 1, respectively.
Figure 5B:
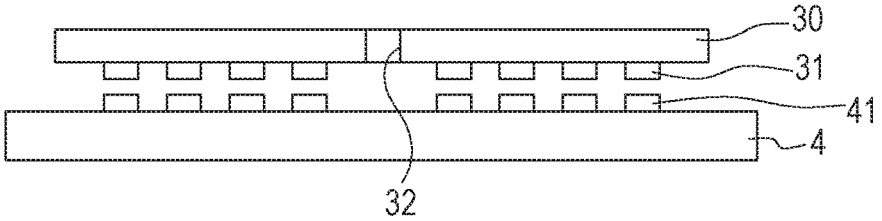
Figure 5C:
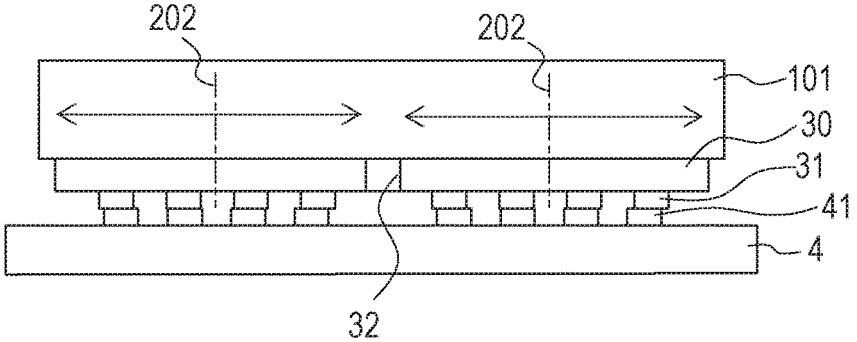
FIG. 5C is a front view illustrating a process of connection thereof.

FIGS. 5A and 5B illustrate a principal portion of the liquid discharge head in Example 1 of the invention. In this example, the cut portion 32 is formed so as to extend from the widthwise center of the connecting portion 30 of the electric wiring hoard 3 in a direction substantially vertical to the width direction. When pressing the connecting portion 30 against the wiring portion 4 by the thermocompression bonding member 101, as illustrated in FIG. 5C, an elongation (illustrated by an arrow) from a center 202 of each of the divided strips 30*a* as a reference point occurs in the width direction. When the connecting portion 30 is divided into a plurality of divided strips 30*a* by forming the cut portion 32 in this manner, the width of each of the divided strips 30*a* is small, and hence an absolute value of the amount of elongation in the width direction becomes small. The positional misalignment occurring locally is smaller in the case of elongation in the width direction occurring in each of the divided strips 30*a* from the center 202 of each of the divided strips 30*a* as a reference point than at least in the case of elongation in the width direction occurring over the entire connecting portion from the center 201 of the connecting portion 30 as a starting point as illustrated in FIG. 4. Accordingly, connection failure and short circuit can be suppressed by reducing the misalignment of relative position with respect to the wiring portion 4, more specifically, the misalignment of relative position between the connecting terminals 31 on each of the electric wiring board side and the connecting terminals 41 on each of the wiring portion side.

The number of the cut portion 32 can be changed desirably, and in the case where one cut portion 32 is formed, there exist the two centers 202 of the divided strips, which are starting points of occurrence of elongation, and in the case where the two cut portions 32 are formed, there exist the three centers 202 of the divided strips. The number of the cut portions 32 are determined while considering the following points with reference to a compression surface area between the electric wiring board 3 and the wiring portion 4 required for transmitting and receiving the electric signal.

- variations in position and variations in width of the connecting terminals 31 of the electric wiring board 3.
- variations in position and variations in width of the connecting terminals 41 of the wiring portion 4.
- Positional accuracy between the electric wiring board 3 and the wiring portion 4.
- the amount of elongation of the electric wiring board 3 and the wiring portion 4 after connection.

In view of such points, if an amount of misalignment of relative position between the connecting terminals 31 and 41 may exceed an allowable range, the cut portion 32 is increased until the amount of the misalignment of the relative position falls within the allowable range. However, if the number of the cut portions 32 is increased, the entire width of the connecting portion 30 is increased, and thus the number of the cut portions 32 can be set to be requisite minimum.

In order to avoid the interference between the adjacent divided strips 30*a* of the connecting portion 30 at the cut portion 32 after the connecting portion 30 and the wiring portion 4 have connected, a width W of the cut portion 32 of the connecting portion 30 can be set to be larger than the amount of elongation in the width direction occurring at the time of connection. The amount of elongation of the connecting portion 30 is determined mainly by a heating amount, control of the amount of elongation is relatively easy.

Figure 5D:
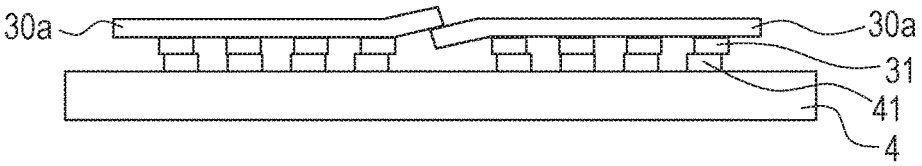
FIG. 5D is a front view illustrating a connecting portion of a modification.

However, as illustrated in FIG. 5D, the width W of the cut portion 32 can be reduced so that the adjacent divided strips of the connecting portion 30 overlap partly with each other (interfere with each other) at the time of expansion. At this time, the control of the amount of elongation is not easy. However, if the number or the size of the wires in the electric wiring board 3 is constant, layout of the wires is easier correspondingly as the width W of the cut portion 32 is small, and thus the entire width of the connecting portion 30 can be reduced. In the case of this configuration, if the adjacent divided strips 30*a* are divided without being continued, the width W of the cut portion 32 can also be almost "0".

A length L of the cut portion 32 is the length exceeding the connecting portion 30 with respect to the wiring portion 4. However, the length L of the cut portion 32 can be set to a length which does not reach a portion abutting on the supporting member 2. If the length L of the cut portion 32 is shorter than a length of the connecting portion 30, thermal expansion (elongation) in the width direction larger than the wiring portion 4 may occur in part of the connecting portion 30 connected to the wiring portion 4. In this case, significant misalignment of the relative position may occur in part of the connecting terminals 31 and 41, and the cut portion 32 may not achieve a sufficient effect. In this example, since the cut portion 32 has a length exceeding the connecting portion 30, the thermal expansion (elongation) in the width direction may be reduced over the entire part of the connecting portion 30.

If the cut portion 32 is provided by a length reaching the portion abutting on the supporting member 2, an adhesive agent for adhering the electric wiring board 3 to the supporting member 2 may protrude from the cut portion 32, and may cause an impact that the protruded adhesive agent is adhered to other members. Therefore, adjustment of an amount or a position of application of the adhesive agent for preventing the adhesive agent from protruding from the cut portion 32 or a process of wiping off the protruded adhesive agent is required. In contrast, in this example as described above, the cut portion 32 has a length which does not reach the portion abutting on the supporting member 2. Accordingly, the adhesive agent for adhering the electric wiring board 3 to the supporting member 2 does not protrude from the cut portion 32, adjustment of the amount and the position of application of the adhesive agent or the process of wiping off the adhesive agent is not necessary.

As illustrated in FIG. 2A, since the length of the cut portion 32 in the width direction is shorter than the length in the direction orthogonal to the width direction, an amount of elongation of the electric wiring board 3 in the width direction due to thermal expansion may be reduced while restricting an increase in size of the electric wiring board 3 in the width direction.

In this example, the thermocompression bonding member 101 for connecting the connecting portion 30 of the electric wiring board 3 to the wiring portion 4 has the substantially same planar shape as the connecting portion 30. The thermocompression bonding member 101 presses the connecting portion 30 against the wiring portion 4 while heating to achieve thermocompression bonding between the connecting terminals 31 and 41. The thermocompression bonding member 101 may have a planar shape larger than the connecting portion 30.

Example 2

Figure 6A:
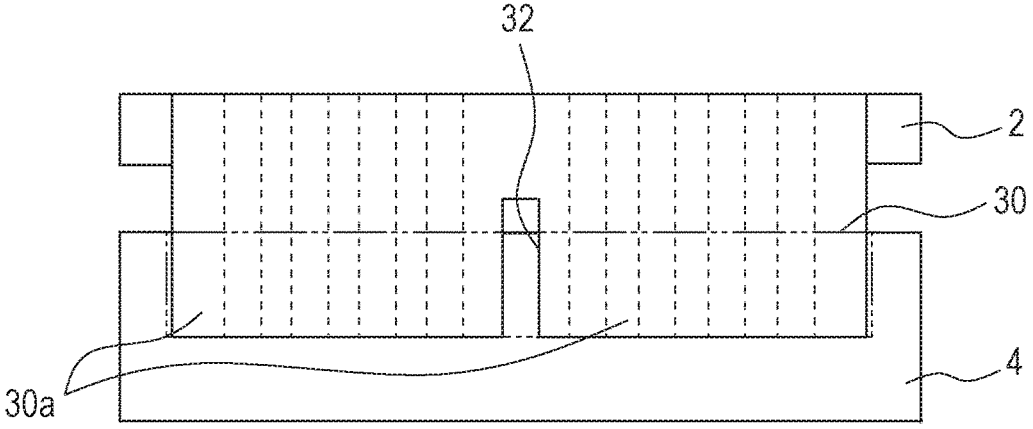
FIGS. 6A and 6B are a development view and a front view illustrating a connecting portion of an electric wiring board in Example 2 of the invention, respectively.
Figure 6B:
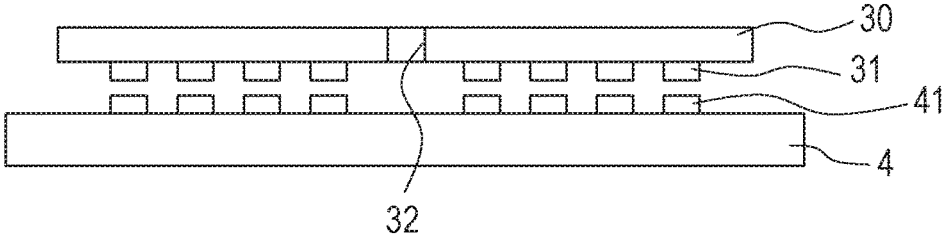
Figure 6C:
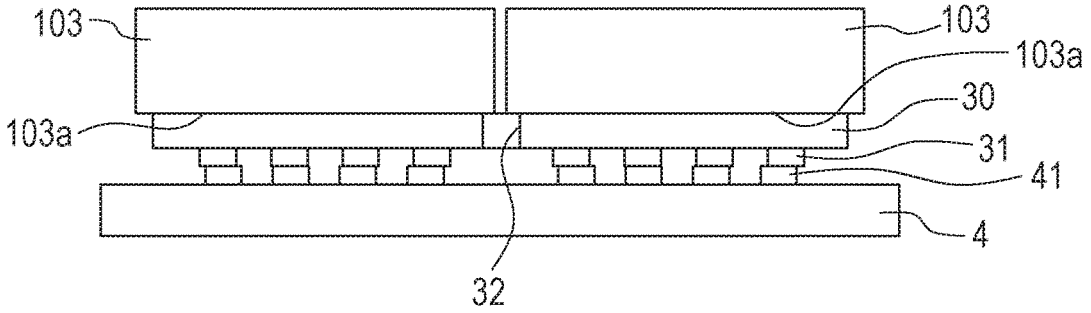
FIG. 6C is a front view illustrating a process of connection thereof.

As illustrated in FIG. 6C, in Example 2 of the invention, a plurality of small thermocompression bonding members 103 having a planar shape corresponding respectively to the divided strips 30*a* of the connecting portion 30 divided by the cut portion 32. Flat surfaces 103*a* configured to press the connecting portion 30 of the thermocompression bonding members 103 are required to have flatness with very high degree of accuracy (on the order of several micrometers). In order to response the requirement, usage of the thermocompression bonding members 103 having a small size is advantageous in terms of machining accuracy.

Figure 7A:
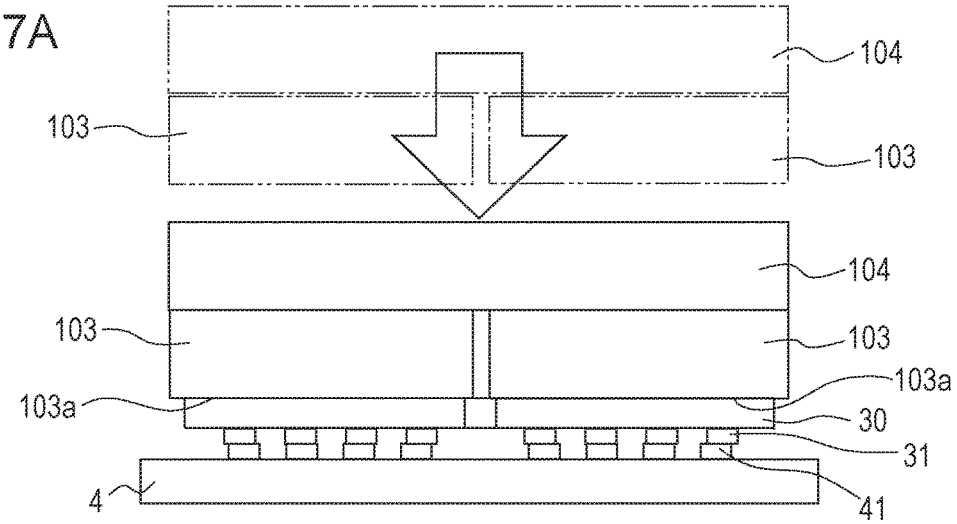
FIG. 7A is a front view illustrating an example of the process of connection of the electric wiring board in Example 2.

FIG. 7A illustrates a configuration in which a plurality of the thermocompression bonding members 103 are mounted on a holding plate 104, and the holding plate 104 and the plurality of thermocompression bonding members 103 are integrally driven by a drive unit, which is not illustrated, in a vertical direction in FIG. 7A. In this configuration, the plurality of divided strips 30*a* of the connecting portion 30 are simultaneously heated and pressed, and are thermocompression bonded to the connecting terminals 31 on the electric wiring board side and the connecting terminals 41 on the wiring portion side. The flat surfaces 103*a* having a high degree of accuracy as described above can be formed easily by using the plurality of small thermocompression bonding members 103, and the connecting work can be performed efficiently in a short time.

Figure 7B:
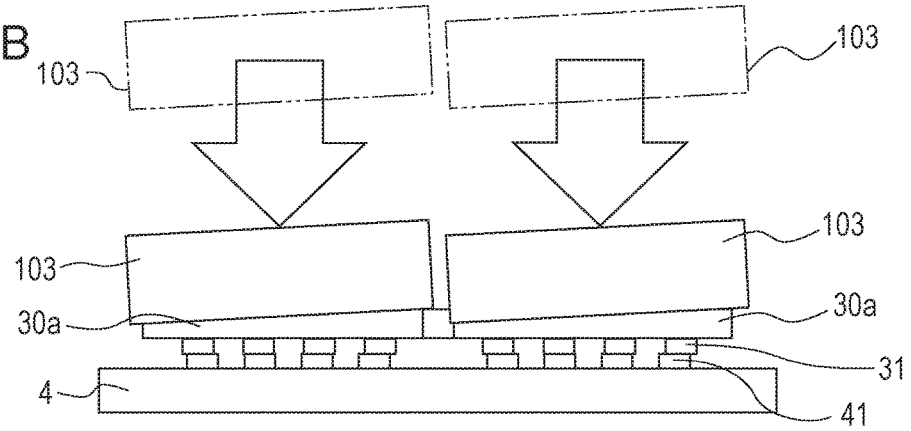
FIG. 7B is a front view illustrating another example of the process of connection of the electric wiring board in Example 2.
Figure 7C:
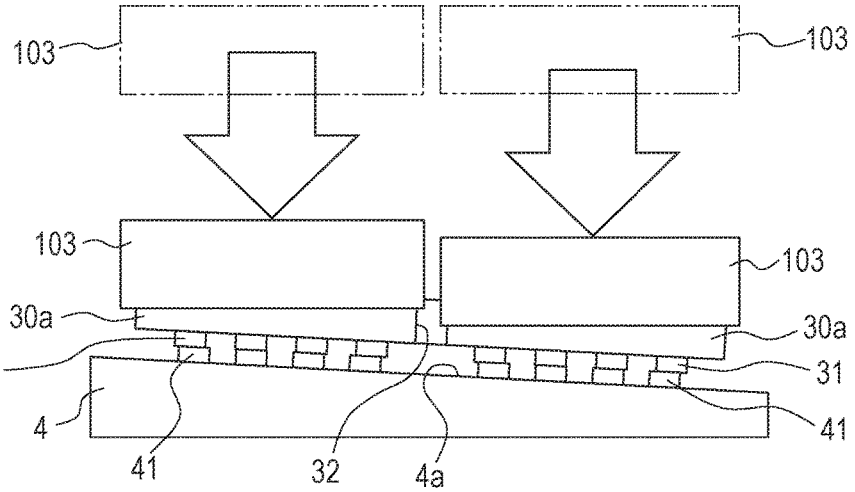
FIG. 7C is a front view illustrating still another example of the process of connection of the electric wiring board in Example 2.

In contrast, FIGS. 7B and 7C illustrate a configuration in which the plurality of thermocompression bonding members 103 can be individually driven. In this configuration, the plurality of divided strips 30*a* of the connecting portion 30 can be heated and pressed simultaneously, and can be heated and pressed separately with time lag. A plurality of driving devices (not illustrated) independent from each other can be provided corresponding to the plurality of divided strips 30*a*. As illustrated in FIGS. 7B and 7C in an exaggerated manner, even though variations in thickness of the divided strips 30*a* of the connecting portion 30 or roughness of a joined surface 4*a* of the wiring portion 4 are present, the connecting terminals 31 can be pressed against the connecting terminals 41 with a relatively uniform pressure to achieve thermocompression bonding. In other words, in this configuration, allowable ranges for the thickness of each of the divided strips 30*a* of the connecting portion 30, the thickness of the wiring portion 4, and flatness of the joined surface 4*a* are relatively wide, and a high degree of accuracy is not required, and thus easy operation is enabled.

Even when the holding plate 104 is used as illustrated in FIG. 7A, or even when the plurality of thermocompression bonding members 103 are independent as illustrated in FIGS. 7B and 7C, a configuration in which elongation of the divided strips 30*a* of the connecting portion 30 in the width direction is realized as illustrated in FIGS. 6A and 6B.

Figure 8:
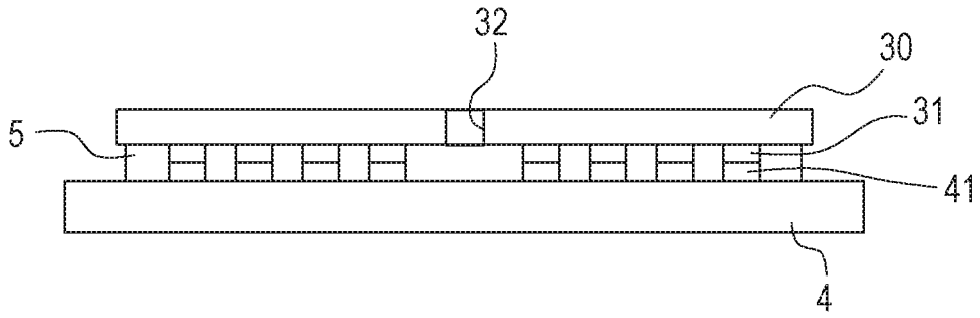
FIG. 8 is a front view illustrating a modification of a connecting portion between an electric wiring board and a wiring portion of the liquid discharge head of the invention.

In the respective examples described thus far, an anisotropic conductive film 5 may be interposed between the connecting portion 30 of the electric wiring board 3 and the wiring portion 4 as illustrated in FIG. 8.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-036827, filed Feb. 26, 2015, which is hereby incorporated by reference herein in its entirety.

What is claimed is:

1. A liquid discharge head comprising:

a print element board including an element for applying discharge energy to liquid;

a first electric wiring board configured to supply an electric signal transmitted from a main body of a liquid discharge apparatus to the print element board; and second electric wiring board including a connecting portion connected to the first electric wiring board and electrically connecting the first electric wiring board and the print element board, wherein the connecting portion is provided with a cut portion at a position between both end portions in a width direction of the connecting portion, and a length of the cut portion in the width direction is shorter than a length of the cut portion in a direction orthogonal to the width direction.

2. The liquid discharge head according to claim 1, wherein the second electric wiring board is a flexible wiring board.

3. The liquid discharge head according to claim 1, wherein a plurality of first connecting terminals are arranged on the first electric wiring board in a row extending along the width direction, a plurality of second connecting terminals are arranged on the connecting portion in a row so as to oppose the row of the plurality of first connecting terminals, and the cut portion is provided between the second connecting terminals so as to separate the row of the second connecting terminals.

4. The liquid discharge head according to claim 1, wherein the length of the cut portion in the width direction is larger than an amount of thermal expansion of the connecting portion in the width direction at the time of connection with the first electric wiring board.

5. The liquid discharge head according to claim 1, wherein the cut portion is formed from an end edge extending in the width direction of the connecting portion, and extends beyond the connecting portion.

6. The liquid discharge head according to claim 1, wherein the amount of thermal expansion of the connecting portion in the width direction is larger than the amount of thermal expansion of the first electric wiring board in the width direction.

7. The liquid discharge head according to claim 1, wherein the cut portion is provided at a position near a middle of both end portions of the connecting portion in the width direction.

8. The liquid discharge head according to claim 1, further comprising:

a supporting member configured to support the print element board and the second electric wiring board, wherein an edge of the second electric wiring board that constitutes an end portion of the cut portion in the orthogonal direction does not abut on the supporting member.

9. The liquid discharge head according to claim 8, further comprising:

a housing including a first surface on which the first electric wiring board is mounted, and a second surface adjacent to the first surface and having the supporting member mounted thereon, wherein the second electric wiring board includes a portion provided on the first surface side and a portion provided on the second surface side, and the edge of the second electric wiring board does not overlap with the supporting member when viewed in a direction orthogonal to the first surface.

10. The liquid discharge head according to claim 1, wherein the second electric wiring board supplies the electric signal supplied by the first electric wiring board to the print element board.

11. The liquid discharge head according to claim 1, wherein a base material of the first electric wiring board and a base material of the second electric wiring board are different from each other.

12. The liquid discharge head according to claim 3, wherein the first connecting terminals and the second connecting terminals are connected respectively.

* * * * *